US005785601A

United States Patent [19]

Kubesheski et al.

[11] Patent Number: 5,785,601

[45] Date of Patent: Jul. 28, 1998

[54] TWO PERSON ROTATING AMUSEMENT APPARATUS

[76] Inventors: John T. Kubesheski; Lenore C. Kubesheski, both of 229 N. Booth St., Dubuque, Iowa 52001

[21] Appl. No.: 770,271

[22] Filed: Dec. 23, 1996

[51] Int. Cl.[6] ..... A36G 23/00

[52] U.S. Cl. ..... 472/135; 482/62

[58] Field of Search ..... 472/14, 15, 26, 472/135; 74/594.4, 594.5; 482/62, 57

[56] References Cited

U.S. PATENT DOCUMENTS 4,345,487 8/1982 Straker ..... 74/594.4 X
5,403,255 4/1995 Johnston ..... 482/57
5,624,356 4/1997 Roberts ..... 74/594.4 X

*Primary Examiner*—Kien T. Nguyen

[57] ABSTRACT

A new Two Person Rotating Amusement Apparatus for primarily entertaining children. The inventive device includes a support frame with handle bars attached thereto, a flywheel supported by the frame and driven by a drive sprocket, and large platforms secured to the drive sprocket. The platforms are large enough to support both feet of a person on each platform, and the handle bars are configured such that each person is able to grasp a portion thereof. One person stands on each platform and holds onto the handle bar, and by cooperative effort cause the drive sprocket to rotate, thus rotating the flywheel. The riders will therefore move up and down and in a circular path on the platforms, aided by the inertia of the flywheel.

13 Claims, 4 Drawing Sheets

TWO PERSON ROTATING AMUSEMENT APPARATUS

BACKGROUND OF THE INVENTION

1. Field of the Invention

The present invention relates to amusement devices and more particularly pertains to a new Two Person Rotating Amusement Apparatus for primarily entertaining children.

2. Description of the Prior Art

The use of amusement devices is known in the prior art. More specifically, amusement devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,203,827; U.S. Pat. No. 5,236,248; U.S. Pat. No. 5,199,933; U.S. Pat. No. 4,004,468; U.S. Pat. No. 4,450,733 and U.S. Pat. No. Des. 307,166. These devices are directed towards exercise bicycles, pedals for bicycles, and associated bicycle apparatus. None of these references, however, teach an amusement apparatus as set forth herein which is specifically designed solely for amusement purposes.

While these devices fulfill their respective, particular objectives and requirements, the aforementioned patents do not disclose a new Two Person Rotating Amusement Apparatus. The inventive device includes a support frame with handle bars attached thereto, a flywheel supported by the frame and driven by a drive sprocket, and large platforms secured to the drive sprocket. The surface of each platform is large enough to support both feet of a person thereon, and the handle bars are configured such that each person is able to grasp a portion thereof.

In these respects, the Two Person Rotating Amusement Apparatus according to the present invention substantially departs from the conventional concepts and designs of the prior art, and in so doing provides an apparatus primarily developed for the purpose of entertaining children.

SUMMARY OF THE INVENTION

In view of the foregoing disadvantages inherent in the known types of amusement devices now present in the prior art, the present invention provides a new Two Person Rotating Amusement Apparatus construction wherein the same can be utilized for primarily entertaining children.

The general purpose of the present invention, which will be described subsequently in greater detail, is to provide a new Two Person Rotating Amusement Apparatus apparatus and method which has many of the advantages of the amusement devices mentioned heretofore and many novel features that result in a new Two Person Rotating Amusement Apparatus which is not anticipated, rendered obvious, suggested, or even implied by any of the prior art amusement devices, either alone or in any combination thereof.

To attain this, the present invention generally comprises a support frame with handle bars attached thereto, a flywheel supported by the frame and driven by a drive sprocket, and large platforms secured to the drive sprocket. The platforms are large enough to support both feet of a person on each platform, and the handle bars are configured such that each person is able to grasp a portion thereof. One person stands on each platform and holds onto the handle bar, and by cooperative effort cause the drive sprocket to rotate, thus rotating the flywheel. The riders will therefore move up and down and in a circular path on the platforms, aided by the inertia of the flywheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Two Person Rotating Amusement Apparatus apparatus and method which has many of the advantages of the amusement devices mentioned heretofore and many novel features that result in a new Two Person Rotating Amusement Apparatus which is not anticipated, rendered obvious, suggested, or even implied by any of the prior art amusement devices, either alone or in any combination thereof.

It is another object of the present invention to provide a new Two Person Rotating Amusement Apparatus which may be easily and efficiently manufactured and marketed.

It is a further object of the present invention to provide a new Two Person Rotating Amusement Apparatus which is of a durable and reliable construction.

An even further object of the present invention is to provide a new Two Person Rotating Amusement Apparatus which is susceptible of a low cost of manufacture with regard to both materials and labor, and which accordingly is then susceptible of low prices of sale to the consuming public, thereby making such Two Person Rotating Amusement Apparatus economically available to the buying public.

Still yet another object of the present invention is to provide a new Two Person Rotating Amusement Apparatus which provides in the apparatuses and methods of the prior art some of the advantages thereof, while simultaneously overcoming some of the disadvantages normally associated therewith.

Still another object of the present invention is to provide a new Two Person Rotating Amusement Apparatus for primarily entertaining children.

Yet another object of the present invention is to provide a new Two Person Rotating Amusement Apparatus which includes a support frame with handle bars attached thereto, a flywheel supported by the frame and driven by a drive sprocket, and large platforms secured to the drive sprocket. The platforms are large enough to support both feet of a person on each platform, and the handle bars are configured such that each person is able to grasp a portion thereof. One person stands on each platform and holds onto the handle bar, and by cooperative effort cause the drive sprocket to rotate, thus rotating the flywheel. The riders will therefore move up and down and in a circular path on the platforms, aided by the inertia of the flywheel.

Still yet another object of the present invention is to provide a new Two Person Rotating Amusement Apparatus that is simple is design and easy to use.

Even still another object of the present invention is to provide a new Two Person Rotating Amusement Apparatus that keeps children entertained for hours at a time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
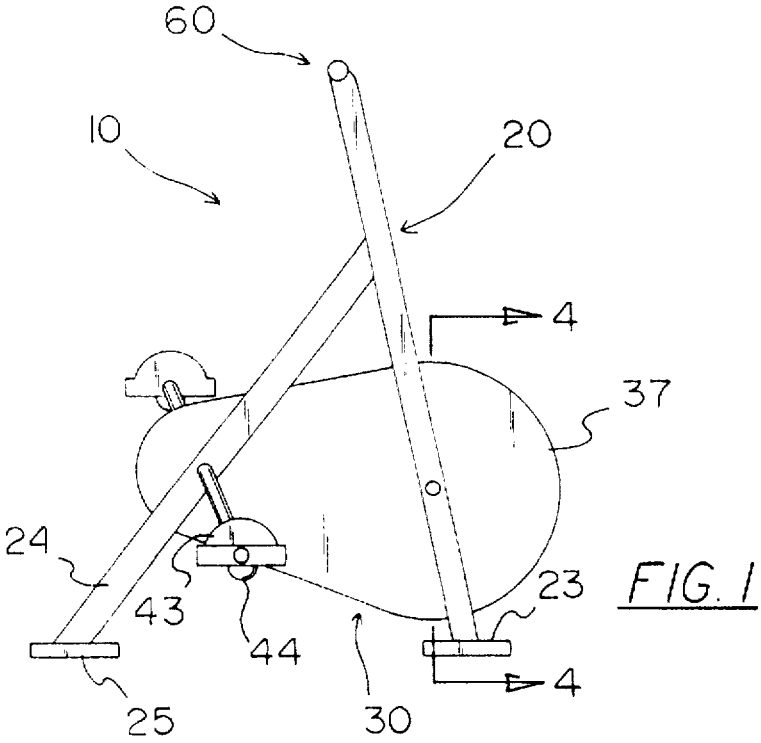
FIG. 1 is a side view of a new Two Person Rotating Amusement Apparatus according to the present invention.

With reference now to the drawings, and in particular to FIGS. 1 through 7 thereof, a new Two Person Rotating Amusement Apparatus embodying the principles and concepts of the present invention and generally designated by the reference numeral 10 will be described.

More specifically, it will be noted that the Two Person Rotating Amusement Apparatus 10 comprises a support frame 20, an apparatus 30 for causing and maintaining rotation, and handle bars 60 attached to the frame 20.

As best illustrated in FIGS. 1 through 7, it can be shown that the support frame 20 comprises two spaced, front support bars 21,22 extending upward at an angle from a front support plate 23. The front support plate 23 supports the front of the frame on a floor or other flat ground. A rear support bar 24 extends at an angle upward from a rear support plate 25, and its opposite end is disposed between the front support bars 21,22 and appropriately attached thereto, such as by welding. The frame should be designed so as to stabily support the weight of at least two adolescent children.

The apparatus 30 includes a flywheel 31 supported for rotation between the bars 21,22 on an axle 32. The axle 32 is supported in the bars 21,22 for rotation relative thereto, such as by ball bearings. The axle 32 also includes a small gear 33 fixed thereto, such that when the gear 33 is rotated, the flywheel 31 simultaneously rotates. A flywheel diameter of about 20 inches has been found to work well in the apparatus 10.

Drive sprocket gear 34 is affixed to axle 35, which is rotationally supported by the rear support bar 24, such as with ball bearings. A drive chain 36 extends between the gear 34 and the gear 33, such that rotation of the gear 34 causes the gear 33 and the flywheel 31 to rotate. The ratio between the diameter of gear 34 and the diameter of gear 33 is, for instance, 3:1, to provide sufficient rotation of the flywheel. A guard 37 encloses the flywheel, gears 33,34, and chain 36, to prevent contact with these items during use. Although the drive apparatus 30 is described as using gears 33,34 and a chain 36, it should be recognized that other driving connections could be used, such as drive pulleys connected by an endless belt.

Pedal means 40 are connected to opposite ends of the axle 35 for causing driving rotation of the gear 34. Each pedal means 40 comprises a crank arm 41 attached at one end to the axle, and a platform 42 attached to the other end of the crank arm. The platforms 42 are preferably oversized when compared to the pedals normally used on bicycles and stationary exercise bikes. For instance, the platforms are preferably about 7.5 inches from its inner end to its outer end, and about 6 inches from front to back. This size provides sufficient area for a person, especially children, to stand comfortably on each platform.

Figure 2:
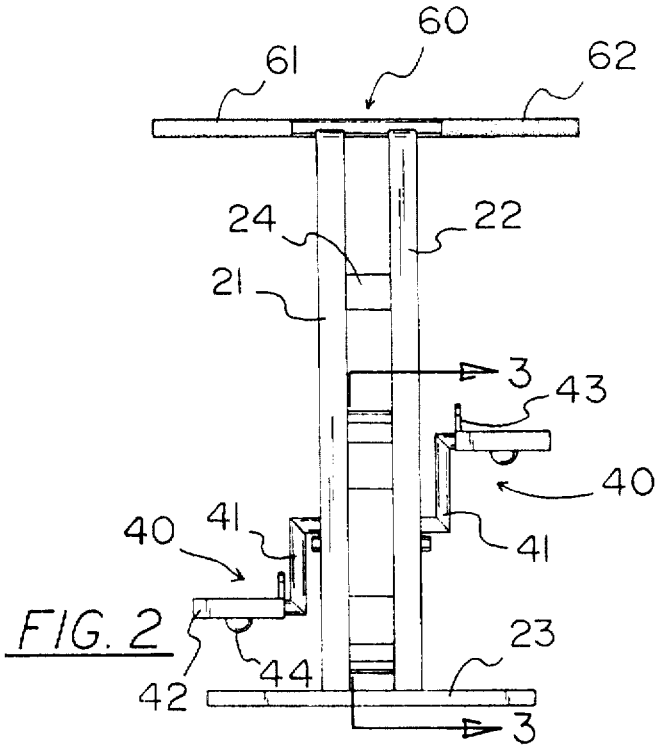
FIG. 2 is a front view thereof.
Figure 3:
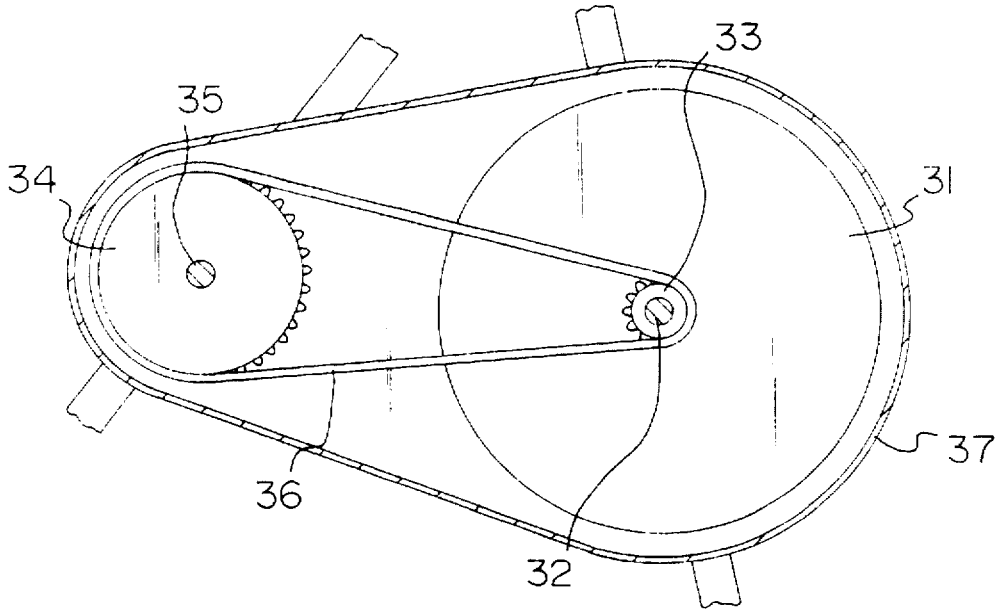
FIG. 3 is a cross sectional view taken along line 3—3 of FIG. 2.
Figure 4:
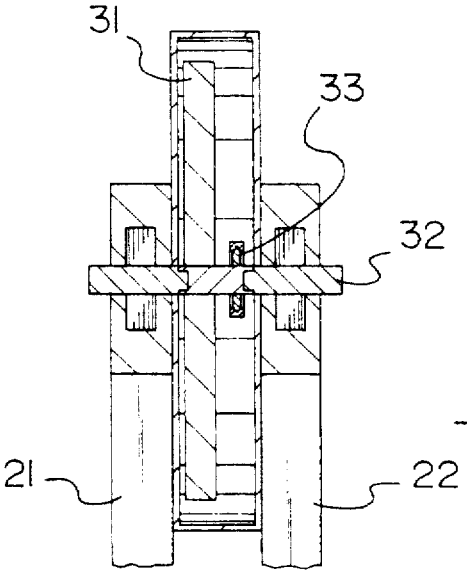
FIG. 4 is a cross sectional view taken along line 4—4 of FIG. 1.

As illustrated in FIGS. 1–2, the platforms 42 are directly attached to the crank arms by means known in the art. The platforms 42 include a rigid guard flange 43 extending from a top surface of each platform, adjacent to the crank arms 41. The flanges 43 prevent the riders feet from contacting the crank arms 41 and the guard 37. The platforms also include a weight 44 attached to a bottom surface thereof having a weight sufficient to maintain the platforms in a substantially horizontal position. The top surface of each platform can also include a non-slip cover or pad attached thereto, such as a rubber pad, to prevent riders feet from slipping off of the platforms.

Figure 5:
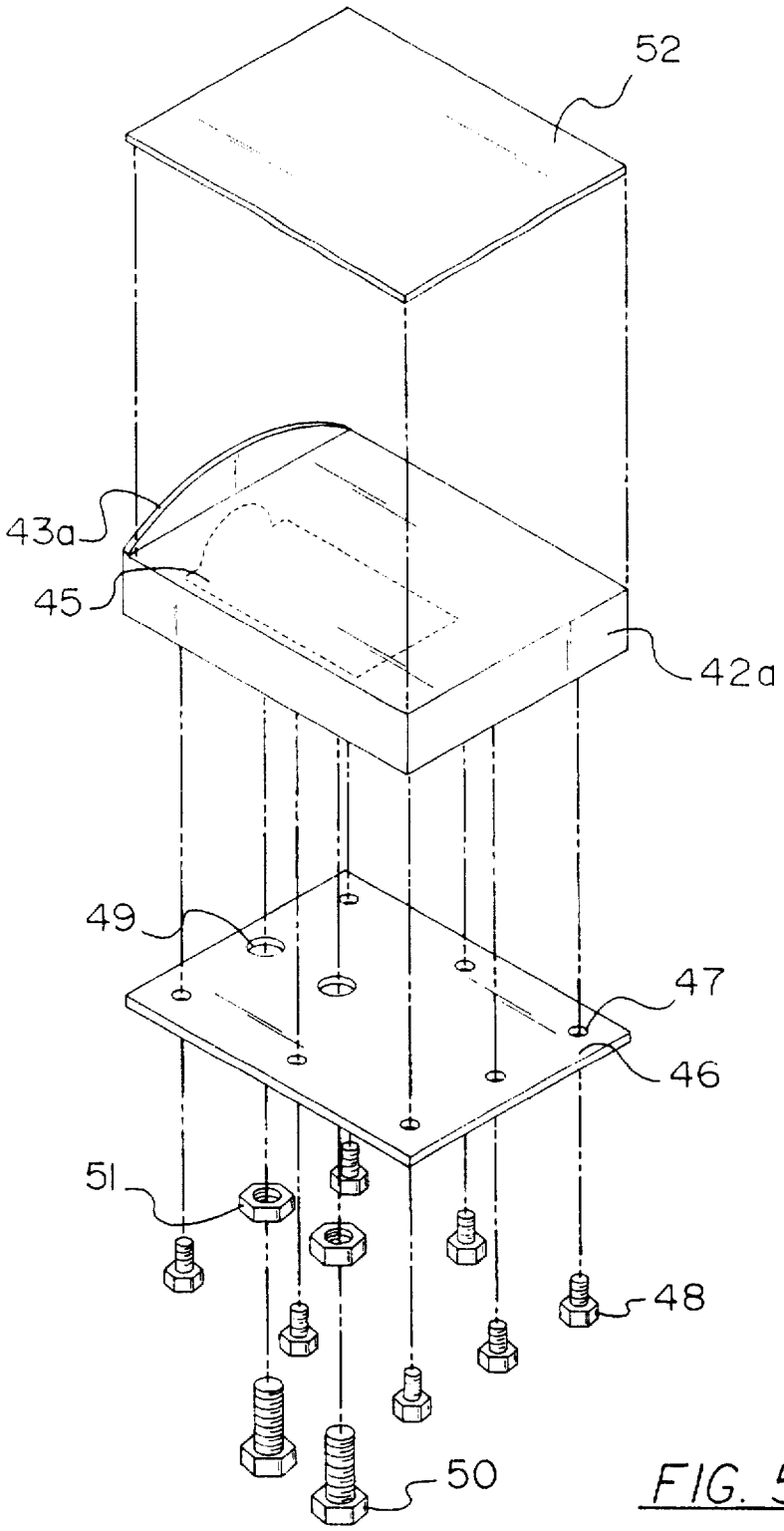
FIG. 5 is an exploded view of a pedal cover assembly.

Instead of being directly connected to the crank arms, platforms can be used which are disposed over normal sized pedals (not shown). As illustrated in FIG. 5, such platforms take the form of an oversized, solid pedal cover 42*a* having a recess 45 (illustrated in dashed line) in a bottom surface of the cover 42*a* which is sized to receive a pedal of the size normally used on bicycles and exercise bikes. The recess 45 is preferably oversized relative to the average pedal, in order to accommodate different sized pedals. The top surface of the pedal cover 42*a* also includes a guard 43*a*.

In order to retain the cover 42*a* on the pedal, securement plate 46 is provided. The plate 46 is sized to cover the recess 45 with the pedal therein, and permit attachment of the plate to the bottom of the cover 42*a*. The plate 46 includes a plurality of holes 47 through which extend threaded fasteners 48. The bottom of the cover 42*a* includes appropriately located threaded holes (not shown) for receiving the fasteners 48. Thus, the fasteners 48 securely attach the plate 46 to the bottom surface of the cover. The plate 46 also includes threaded holes 49 which receive bolts 50. Threaded jam nuts 51 are placed between the plate 46 and the head of the bolts 50. The bolts 50 are screwed into the holes 49 until the bolt ends contact the bottom of the pedal which is in the recess. The jam nuts 51 are then tightened to lock the bolts in place. By screwing the bolts 50 until they contact the bottom of the pedal, the cover 42*a* and plate 46 are rigidly secured to the pedal, preventing shifting and other movements of the cover 42*a* and plate 46 on the pedal. In addition, the bolts 50 and nuts 51 acts as weights to maintain the cover 42*a* substantially horizontal. Rubber non-slip pad 52 is secured to the top of the cover 42*a*, such as by adhesives, in order to prevent slipping of riders feet on the cover 42*a*.

The handle bar 60 is secured to the distal ends of the front support bars 21,22. As illustrated in FIG. 2, the bar 60 is a single, elongated member having enlarged gripping surfaces 61,62 at each end of the bar. The surfaces 61,62 are sized such that two hands can comfortably grip each surface. The surfaces 61,62 can be covered with a non-slip covering, such as handle bar tape or a rubber-type cover.

Figure 6:
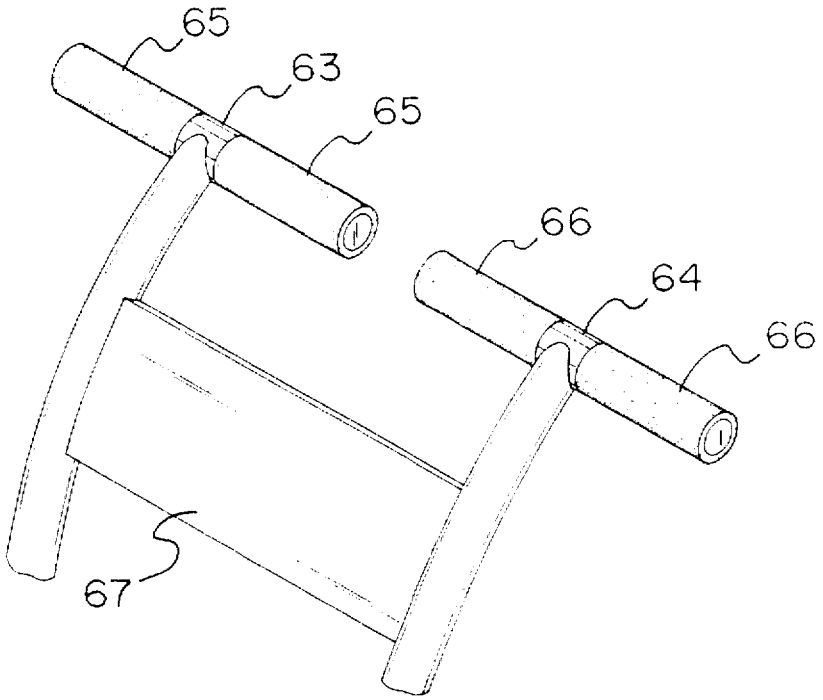
FIG. 6 is a view of an alternate embodiment of the handle bars.
Figure 7:
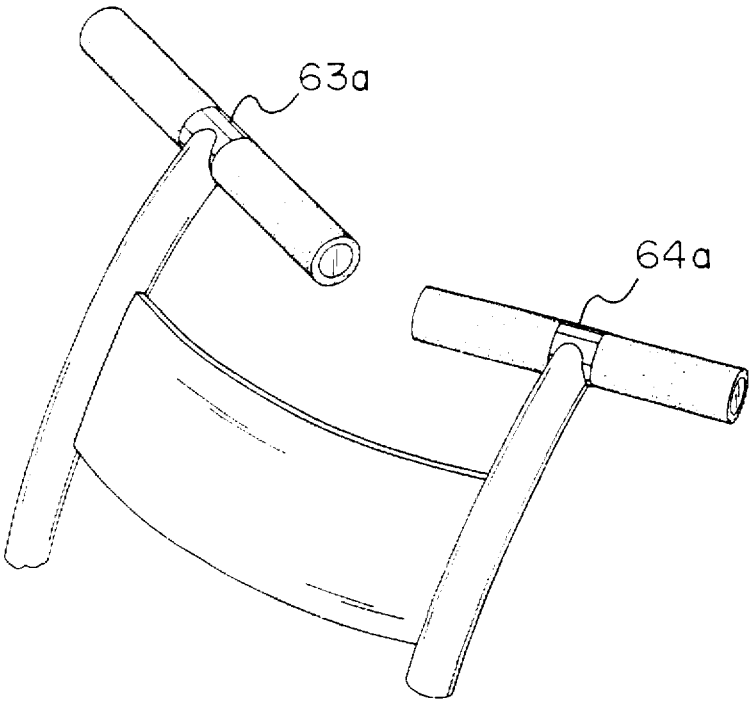
FIG. 7 is a view of another embodiment of the handle bars.

Instead of a single bar, two unconnected bars 63,64 can be used, as is shown in FIG. 6. One bar 63 is connected to the end of the support bar 21 while the other bar 64 is connected to the support bar 22. Bar 63 includes two gripping surfaces 65, and bar 64 also includes two gripping surfaces 66. Therefore, a rider standing on one platform can grip the surfaces 65 of bar 63 with each hand, while the other rider grips the surfaces 66 of bar 64. Plate 67 preferably extends between the bars 21,22, in order to stiffen the bars at this end since the handle bars 63,64 are unconnected. The plate 67 also provides a handy location for placing logos, such as a manufacturers logo. In order to make it easier for a rider to grasp the handle bars, the bars 63*a*,64*a* can be angled such that the outer ends are angled backward towards the rider, as illustrated in FIG. 7.

In use, one rider stands on one of the platforms, while a second rider stands on the other platform. By cooperative effort, the riders cause the platforms, crank arms and sprocket to rotate, similar to a bicycle. This causes the flywheel to rotate, due to the chain and flywheel gear. Thus the riders move in a circular path, both up and down and front and back on the apparatus. Due to the size and mass of the flywheel, motion is easily maintained once it is started.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. An amusement apparatus comprising:

a support frame;

handle bar means attached to the frame for grasping by the hands of a plurality of individuals;

a flywheel rotationally supported by the frame;

a drive sprocket rotationally supported by the frame and in driving connection with the flywheel;

a pedal means connected to the drive sprocket for rotationally driving the drive sprocket, said pedal means comprising crank arms attached to the drive sprocket and platforms secured to the ends of the crank arms;

each platform further including a pedal cover means placed over a pedal, each pedal sized to permit an individual to stand thereon with his or her two feet supported thereby; and wherein each said pedal cover means comprises a pedal cover having a recess in a bottom surface thereof sized to receive the pedal therein, and a securement plate disposed over the recess and secured to the bottom surface of the pedal cover.

2. The amusement apparatus of claim 1, wherein the platforms are directly connected to the crank arms.

3. The amusement apparatus of claim 1, further comprising a non-slip pad secured to an upper surface of the pedal cover.

4. The amusement apparatus of claim 1, wherein the handle bar means comprises a single elongated bar having opposite ends, each end having a gripping surface sized to permit grasping by a plurality of hands.

5. The amusement apparatus of claim 1, wherein the handle bar means comprises two unconnected bars, each bar having two gripping surfaces thereon sized to permit grasping by a plurality of hands.

6. The amusement apparatus of claim 5, wherein each bar includes inner and outer ends, the outer ends being angled backward toward a rear of the frame.

7. The amusement apparatus of claim 1, wherein each platform includes a rigid guard flange adjacent to the respective crank arm and extending from an upper surface of the platform to prevent contact between the crank arms and the individuals feet.

8. An amusement apparatus comprising:

two front support bars extending upward from a front support plate and a rear support bar extending from a rear support plate and attached to the front support bars;

handle bar means attached to the front support bars for grasping by the hands of a plurality of individuals;

a flywheel rotationally supported by the front support bars;

a drive sprocket rotationally supported by the rear support bar and in driving connection with the flywheel, the drive sprocket and flywheel being covered by a guard;

a pedal means connected to the drive sprocket for rotationally driving the drive sprocket, said pedal means comprising crank arms attached to the drive sprocket and platforms secured to the ends of the crank arms;

each platform further including a pedal cover means placed over a pedal, each pedal sized to permit an individual to stand thereon with his or her two feet supported thereby, each pedal further including a rigid guard flange adjacent to the respective crank arm and extending from an upper surface of the pedal to prevent contact between the crank arms and the individuals feet, the pedals being weighted so that the upper surface of the pedals remains substantially horizontal; and wherein each said pedal cover means comprises a pedal cover having a recess in a bottom surface thereof sized to receive the pedal therein, and a securement plate disposed over the recess and secured to the bottom surface of the pedal cover.

9. The amusement apparatus of claim 8, wherein the platforms are directly connected to the crank arms.

10. The amusement apparatus of claim 8, further comprising a non-slip pad secured to the upper surface of the pedal cover.

11. The amusement apparatus of claim 8, wherein the handle bar means comprises a single elongated bar having opposite ends, each end having a gripping surface sized to permit grasping by a plurality of hands.

12. The amusement apparatus of claim 8, wherein the handle bar means comprises two unconnected bars, each bar being connected to one of the front support bars and having two gripping surfaces thereon sized to permit grasping by a plurality of hands.

13. The amusement apparatus of claim 12, wherein each bar includes inner and outer ends, the outer ends being angled backward toward the rear support bar.

* * * * *